US008307796B2

(12) United States Patent
Bayrakdar

(10) Patent No.: US 8,307,796 B2
(45) Date of Patent: Nov. 13, 2012

(54) CAMSHAFT ADJUSTER FOR AN INTERNAL COMBUSTION ENGINE WITH IMPROVED DESIGN OF THE PRESSURE CHAMBERS

(75) Inventor: Ali Bayrakdar, Rothenbach/Pegnitz (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 450 days.

(21) Appl. No.: 12/598,512

(22) PCT Filed: Apr. 28, 2008

(86) PCT No.: PCT/EP2008/055128

§ 371 (c)(1),
(2), (4) Date: Nov. 2, 2009

(87) PCT Pub. No.: WO2008/135420

PCT Pub. Date: Nov. 13, 2008

(65) Prior Publication Data

US 2010/0126450 A1 May 27, 2010

(30) Foreign Application Priority Data

May 2, 2007 (DE) ..... 10 2007 020 526

(51) Int. Cl.
*F01L 1/34* (2006.01)

(52) U.S. Cl. ..... 123/90.17

(58) Field of Classification Search ..... 123/90.15, 123/90.17

See application file for complete search history.

(56) References Cited

U.S. PATENT DOCUMENTS

| | | | | |
|---|---|---|---|---|
| 5,205,249 | A * | 4/1993 | Markley et al. | 123/90.17 |
| 5,738,056 | A * | 4/1998 | Mikame et al. | 123/90.17 |
| 6,267,089 | B1 * | 7/2001 | Golovatai-Schmidt | 123/90.17 |
| 2003/0062011 | A1 | 4/2003 | Hori | |

FOREIGN PATENT DOCUMENTS

| | | |
|---|---|---|
| DE | 19708661 | 9/1998 |
| DE | 19817319 | 10/1999 |
| DE | 102005026553 | 9/2006 |
| EP | 0799977 | 10/1997 |

* cited by examiner

*Primary Examiner* — Kenneth Bomberg
*Assistant Examiner* — Daniel Bernstein
(74) *Attorney, Agent, or Firm* — Volpe and Koenig, P.C.

(57) ABSTRACT

A camshaft adjuster which has an improved configuration of the pressure chambers and of the adjoining pressure chamber surfaces is provided, that is attached at the end side to a camshaft (2), coaxially about a camshaft axis (3), and which acts as a transmission element to a drive wheel (4) for rotationally driving the camshaft (2), having an inner wheel (5) which is arranged so as to be rotationally fixed with respect to the camshaft (2) and having an outer wheel (6) which is arranged so as to be rotatable, and coaxial, with respect to the inner wheel (5). At least one inner wheel vane (7) is arranged on the inner wheel (5) and at least one outer wheel vane (8) is arranged on the outer wheel (6), between which inner wheel vane(s) (7) and outer wheel vane(s) (8) are formed pressure chambers (9, 9*a*). The inner wheel vanes (7) delimit the pressure chambers (9, 9*a*) with a lateral pressure chamber surface (10), and radial bores (11) are formed in the inner wheel vane (7) for a pressure medium supply to the pressure chambers (9, 9*a*). The inner wheel vanes (7) have, within the pressure chamber surface (10), at least one recess (12) into which the respective radial bores (11) open.

7 Claims, 2 Drawing Sheets

CAMSHAFT ADJUSTER FOR AN INTERNAL COMBUSTION ENGINE WITH IMPROVED DESIGN OF THE PRESSURE CHAMBERS

BACKGROUND

The present invention relates to a camshaft adjuster for an internal combustion engine, wherein this camshaft adjuster is mounted on a camshaft coaxial about a camshaft axis and acts as a transmission element to a drive wheel for the rotational driving of the camshaft, and has an inner wheel arranged locked in rotation to the camshaft and an outer wheel that can rotate, and that is arranged coaxial, relative to this inner wheel, wherein at least one inner wheel vane is arranged on the inner wheel and at least one outer wheel vane is arranged on the outer wheel, wherein pressure chambers are formed between these vanes and the inner wheel vanes which define the pressure chambers with pressure chamber surfaces on the peripheral side, wherein radial boreholes are formed in the inner wheel for supplying pressurized medium to the pressure chambers.

A camshaft adjuster according to the class is already known from DE 198 17 319 C2. Camshaft adjusters of this type comprise several pressure chambers that are arranged on the periphery and that allow the inner wheel to rotate relative to the outer wheel when pressurized. For example, the phase position of the camshaft relative to the phase position of the drive wheel can be changed through pressurization. The drive wheel is driven via the crankshaft of the internal combustion engine by a traction mechanism. By adjusting the phase position of the camshaft, the control times of the intake and exhaust valves can be changed, in order to optimize the valve timing as a function of the operating point of the internal combustion engine. The inner wheel of such a camshaft adjuster has several inner wheel vanes that extend radially outward. Outer wheel vanes that point radially inward from the outer wheel extend into the intermediate spaces of the inner wheel vanes, so that the pressure chambers are formed between the vanes. Pressurized medium is fed to and discharged from the pressurized medium chambers via radial boreholes extending in the base body of the inner wheel. For controlling the pressurized medium, one control valve is provided that comprises a valve slide formed within the camshaft adjuster concentric to the camshaft axis. The valve slide is shifted axially by a central magnet arranged on the outside, in order to control the pressurization and also the depressurization of the pressure chambers. The radial boreholes extend in the radial direction from the control valve arranged centrally within the inner wheel into the pressure chambers, wherein the radial boreholes open outward from the base body of the inner wheel adjacent to the inner wheel vanes.

As an alternative to the use of a central valve, a pressurized medium distributor could be arranged within the camshaft adjuster concentric to the camshaft axis. This pressurized medium adjuster is used to guide the controlled flows of pressurized medium controlled by an external control valve that is housed, for example, in a cylinder head borehole, into the camshaft adjuster. In the case of such a design of the pressure chambers between the inner wheel and the outer wheel of a camshaft adjuster, there is the problem that the pressure chamber can be filled with pressurized medium not at all or only with difficulty, when the lateral pressure chamber surfaces of the inner wheel vanes contact the adjacent surfaces of the outer wheel vanes. In one state, this is the case in which the camshaft adjuster is located at a maximum advanced position or a maximum retarded position. In this case, a group of pressure chambers is filled completely with pressurized medium, while the other groups of pressure chambers are completely emptied. If the emptied pressure chambers are pressurized by the control valve via the radial boreholes, then an opening of the pressure chamber can be blocked for rotating the inner wheel relative to the outer wheel when the adjacent lateral pressure chamber surfaces bond to each other. The pressurized medium can be led only with difficulty between the contacting surfaces, so that the rotation of the inner wheel relative to the outer wheel is performed delayed or even blocked.

SUMMARY

Therefore, the object of the present invention is to create a camshaft adjuster that has an improved design of the pressure chambers and the adjacent pressure chamber surfaces.

The invention includes the technical teaching that at least one inner wheel vane has a recess within the pressure chamber surface, wherein a corresponding radial borehole opens into this recess.

Here, the invention starts with the idea of providing the recesses in the inner wheel vanes, such that a residual pressure chamber remains between the inner wheel vanes and the outer wheel vanes when the lateral pressure chamber surfaces are placed one against the other, in order to obtain a sufficiently large surface area that can be pressurized between the vanes. By pressurizing the surfaces adjacent to the residual pressure chamber, a rotational movement of the inner wheel relative to the outer wheel can be introduced. As soon as the lateral pressure chamber surfaces lift apart from each other, the pressurized medium can reach between the surfaces, in order to establish the necessary operating pressure in the pressure chambers and in order to guarantee the secure rotation of the inner wheel relative to the outer wheel.

In one refinement of the invention, the inner wheel has a central opening that is formed concentric to the camshaft axis in the inner wheel, wherein the radial borehole extends between the opening and the recess.

Advantageously, the inner wheel has a valve slide chamber for holding a valve slide that is formed concentric about the camshaft axis centrally in the inner wheel. The radial boreholes extend between the valve slide chamber and the recesses within the inner wheel vanes, such that these radial boreholes open out from the base body of the inner wheel in the region in the pressure chambers in which the recesses in the inner wheel vanes begin. Thus, the pressurized medium flows directly through the radial boreholes into the recesses.

According to one advantageous embodiment of the inner wheel, this is formed from the base body from which the inner wheel vanes extend radially outward. The outer wheel vanes extend radially inward into the intermediate spaces and form the intermediate pressure chambers with the corresponding lateral boundaries. The recesses begin in the region of the base body in the pressure chamber surface and run radially outward and can even continue into the base body, so that these recesses are formed as boreholes that extend into the base body and that transition into the radial boreholes.

Advantageously, the recess extends in the radial direction along the entire length of the inner wheel vane. In this way, the torque on the inner wheel is increased, because the lever increases with increasing distance from the rotational axis.

In one refinement of the invention, it is provided that, in one peripheral-side end position of the inner wheel relative to the outer wheel, a pressure chamber surface contacts a side surface of the corresponding outer wheel vane and the corresponding recess in the pressure chamber surface forms a residual pressure chamber. Here, it could be provided that the surface area of the side surface of the outer wheel vane on which the pressure chamber surface comes into contact in one peripheral-side end position of the inner wheel relative to the outer wheel comprises at least 20%, advantageously, at least 30% of the surface area of the side surface. Through this lower limit of the contact surface area of the pressure chamber surface of the inner wheel vane on the side surface of the outer wheel vane, wear is avoided on these components during the stop or contact, while allowing a quicker response from this position.

It is advantageous that, in the case of depressurization of the pressure chambers, the pressure chamber surfaces are adjacent to the corresponding side surfaces of the outer vanes and the corresponding recesses in the pressure chamber surfaces form a residual pressure chamber. Advantageously, the recesses here have a circular cross section in a direction of the radial extent in the inner wheel vane and are arranged on the corresponding edge of the pressure chamber surface relative to the side surface of the inner wheel vanes.

In one preferred embodiment, the recess is arranged on one edge of the pressure chamber surface relative to the side surface of the chamber inner vanes. The arrangement of the recess on one edge of the chamber inner vane considerably simplifies the production, for example, by sintering technology.

At least one chamber inner vane should have a recess. Alternatively, it could also be provided that each of the chamber inner vanes is formed with at least one recess. In this way, only one or two pressure chamber surfaces of the chamber inner vane could have a recess.

Through the design of recesses on the pressure chamber surfaces of the inner wheel vanes it is guaranteed that a residual pressure chamber is present even when the pressure chamber surface comes to contact a counter surface of the outer wheel. Through the design of the recesses in the radial direction, the conversion of pressure to torque is increased due to the increase of the lever, wherein simultaneously a sufficient contact surface can be realized, in order to minimize wear on the pressure chamber surface and the counter surface.

According to another advantageous embodiment of the camshaft adjuster according to the invention, the camshaft comprises a pressurized medium supply borehole that is arranged in the radial direction and that opens into an axial countersink borehole formed in the camshaft. In order to create an even more improved pressurized medium supply, several, advantageously four pressurized medium supply boreholes are arranged in a uniformly distributed configuration on the periphery of the camshaft, wherein these boreholes each open into the central countersink borehole. The countersink borehole has a larger diameter than the pressurized medium supply boreholes, wherein the countersink borehole is advantageously constructed so that this borehole can be used for the insertion of centering pins that are required for a metal-cutting production of the camshaft.

The pressurized medium supply path into the pressure chambers is realized initially by the pressurized medium supply borehole and transitions into the countersink borehole that transitions to the adjacent valve slide chamber in which the valve slide is housed. Thus, the pressurized medium first reaches the valve slide chamber, wherein the pressurized medium supply path extends as a function of the axial position of the valve slide via the valve slide chamber and via the radial boreholes into the pressure chambers. The valve slide is held so that it can move axially within the valve slide chamber, so that, as a function of the switch position of the valve slide, the radial boreholes can be connected fluidly either to the pressurized medium supply or via depressurization chambers for depressurization of the pressure chambers.

One refinement of the camshaft adjuster according to the invention comprises two stop disks, wherein the inner wheel vane and also the outer wheel vane are arranged between these disks. The camshaft has an end-side flange section by which the camshaft adjuster is attached to the camshaft. For passing the pressurized medium through the stop disk that is arranged adjacent to the flange section of the camshaft, this disk has several passage boreholes that are arranged in a uniformly distributed configuration on the periphery of the stop disk. The passage boreholes align in the axial direction with pressurized medium channels through which the pressurized medium reach the control chambers of the control valve. Starting from the control chambers, the pressurized medium can reach into the radial boreholes as a function of the switch position of the valve slide.

BRIEF DESCRIPTION OF THE DRAWINGS

Additional measures for improving the invention are described in more detail below together with the description of a preferred embodiment of the invention with reference to the figures. Shown are.

DETAILED DESCRIPTION OF THE PREFERRED EMBODIMENTS

Figure 1:
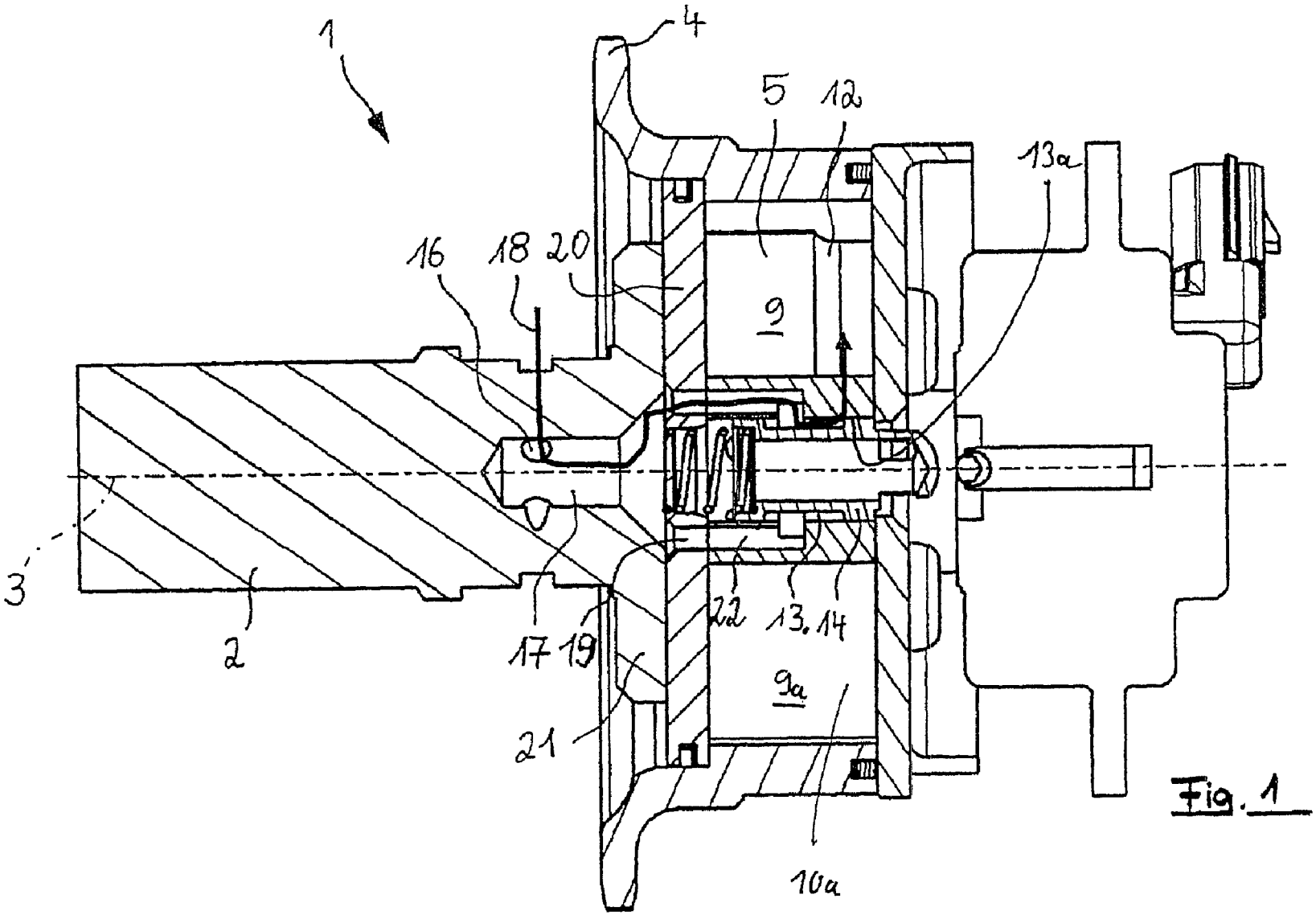
FIG. 1 a longitudinal section through a camshaft adjuster according to the invention, wherein the pressurized medium supply path into the pressure chambers is designated, FIG. 2 a view of the camshaft adjuster according to the invention from the viewpoint of the camshaft axis in which the recesses within the inner wheel vane are shown, and FIG. 3 a perspective view of an inner wheel.

In FIG. 1, a camshaft adjuster 1 is shown that is arranged on a camshaft 2 on the end side. The camshaft adjuster 1 extends concentric to the camshaft axis 3 and acts as a transmission element between a drive wheel 4 and the camshaft 2, wherein the drive wheel 4 is driven by a traction mechanism, such as a chain, a toothed belt, or the like, by the crankshaft of the internal combustion engine.

The camshaft adjuster 1 comprises an inner wheel 5 that is connected locked in rotation with the camshaft 2. The inner wheel 5 has several inner wheel vanes that are distributed uniformly on the periphery and in which recesses 12 are formed. Pressure chambers that can be pressurized with a pressurized medium extend between the inner wheel vanes and also outer wheel vanes arranged between the inner wheel vanes. For this purpose, a control valve or a pressurized medium distributor is provided within a central opening 13*a* within the inner wheel 5. In the case of a control valve, the central opening is formed as a valve slide chamber 13 in which a valve slide 14 is housed. Corresponding radial boreholes (not visible in the section) extend between the valve slide chamber 13 in which the valve slide 14 is housed so that it can move in the axial direction and the recesses 12, wherein the pressurized medium reaches into the pressure chambers through these radial boreholes.

The path of the pressurized medium supply is indicated by the pressurized medium supply path 18 that shows the entire supply path from the outside of the camshaft adjuster 1 into the pressure chamber. The pressurized medium initially reaches through several pressurized medium supply boreholes 16 that are formed radially in the camshaft 2 into a countersink borehole 17 that is formed in the camshaft concentric to the camshaft axis 3 from the direction of the end side of the camshaft 2. Here, the countersink borehole 17 is formed in the shape of a centering borehole and has a tapering section increasing toward the end side of the camshaft 2.

The camshaft adjuster 1 is attached by a screw connection to a camshaft flange that is formed as a flange section 21 on the end side on the camshaft 2. A stop disk 20 that forms the side boundary of the inner wheel 5 or the outer wheel and thus of the pressure chambers is arranged adjacent to the camshaft flange 21. The stop disk 20 has several passage boreholes 19 that are in fluid contact with the countersink borehole 17. Pressurized medium channels 22 within the inner wheel 5 extend flush with the passage boreholes 19, so that the pressurized medium reaches from the countersink borehole 17 via the passage boreholes 19 within the stop disk 20 into the pressurized medium channels 22, in order to reach into the control chamber of the control valve that can be either opened or closed by the valve slide 14 to the radial boreholes. As a function of the axial control position of the valve slide 14, the control chambers are connected fluidly within the valve slide chamber 13 to the radial boreholes, so that the pressurized medium can flow into the corresponding recesses 12 in the inner wheel vanes. Thus, a simple construction of the pressurized medium supply is created that requires no additional components and the pressurized medium can reach into the pressure chambers through a simple arrangement of the control valve and the pressure chambers can also be depressurized by the control valve in a similarly simple manner.

Figure 2:
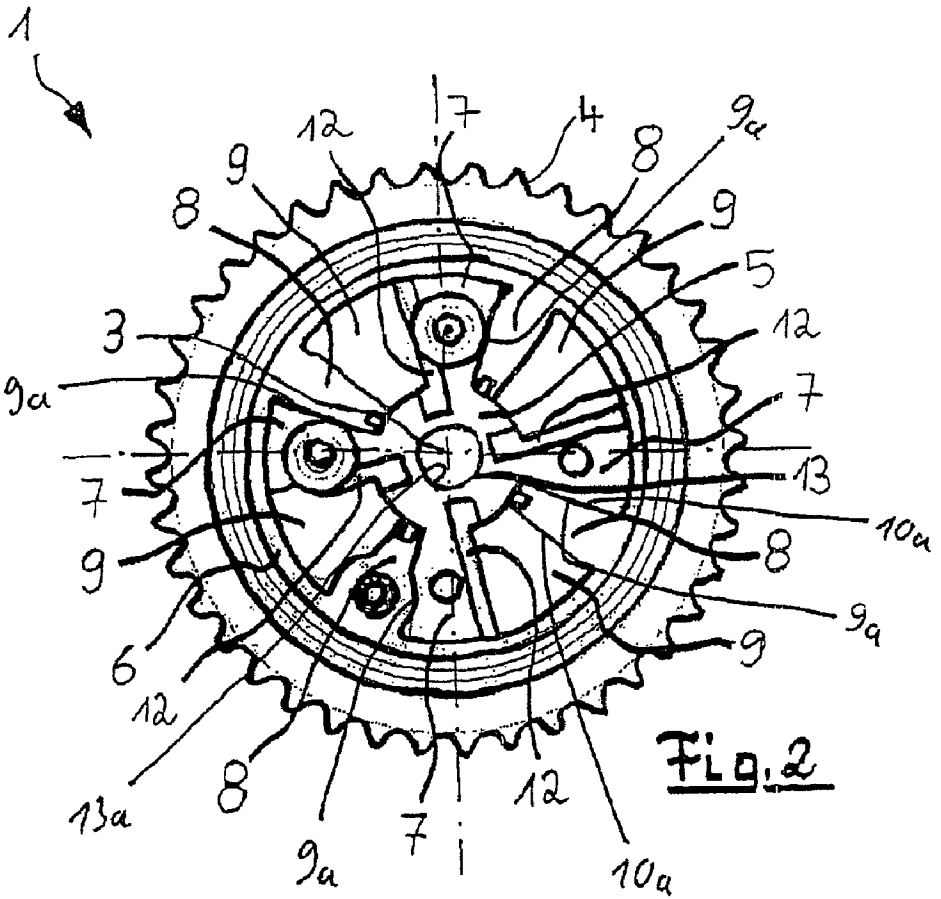

FIG. 2 shows a top view of a camshaft adjuster 1 from the viewpoint of the camshaft axis 3. Shown is the outer-side drive wheel 4 within which both the inner wheel 5 and also the outer wheel 6 are located. The inner wheel 5 is formed within the outer wheel 6, wherein four inner wheel vanes 7 extend from the inner wheel 5 outward in the radial direction. Four outer wheel vanes 8 extend from the outer wheel 6 inward in the radial direction, so that these project into the intermediate spaces between the inner wheel vanes 7. Four first pressure chambers 9 and four second pressure chambers 9*a* that act against the first pressure chambers 9 extend between the inner wheel vanes 7 and the outer wheel vanes 8. The pressure chambers 9, 9*a* are bounded in the peripheral direction by pressure chamber surfaces 10 that are formed on the inner wheel vanes and side surfaces 10*a* that bound the outer wheel vanes 8 in the peripheral direction. Through a pressurization of one group of pressure chambers 9, 9*a* and a simultaneous depressurization of the other group of pressure chambers 9, 9*a*, the inner wheel 5 can rotate relative to the outer wheel 6. Because the inner wheel 5 is connected locked in rotation with the camshaft, the camshaft can rotate relative to the drive wheel 4. The valve slide chamber 13 in which the valve slide is inserted extends centrally around the camshaft axis 3.

According to the present invention, each inner wheel vane 7 has recesses 12 that are formed in both pressure chamber surfaces and run in the radial direction beginning at a base body 15 of the inner wheel 5 up to the outside of the inner wheel vanes 7. In the illustrated arrangement, the first pressure chambers 9 are pressurized, so that these are opened. The recesses 12 are located on the side of the pressure chambers 9, 9*a*, so that when the pressure chamber surfaces of the inner wheel vanes 7 and the outer wheel vanes 8 contact each other, a residual pressure chamber is formed. It is clear to see that the recesses 12 continue into the base body of the inner wheel 5 and are formed on the—in the plane of the figure—front edge of the inner wheel vanes by a metal-cutting or an erosive method.

Figure 3:
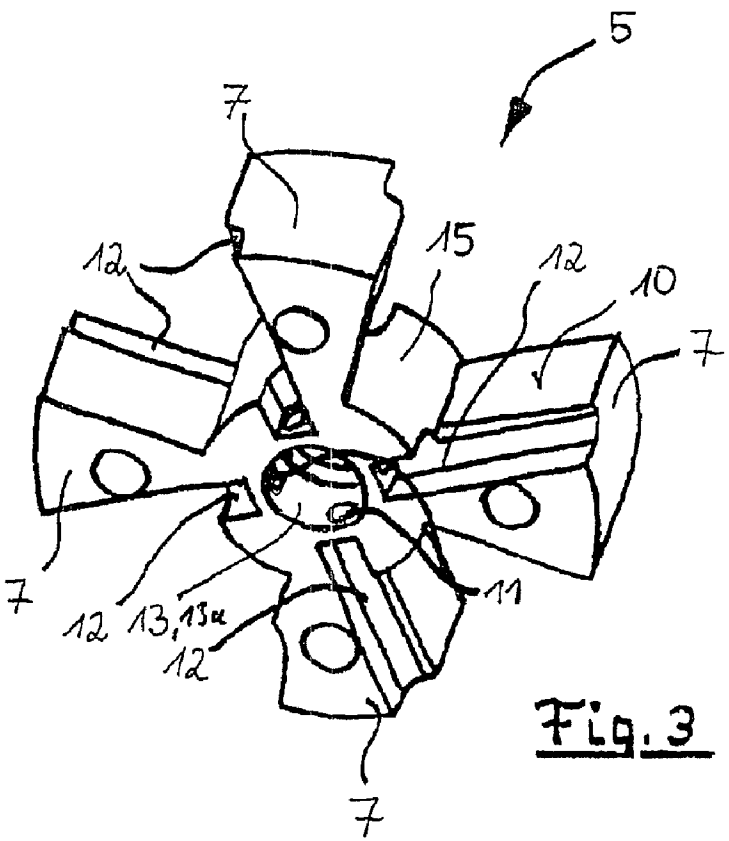

In FIG. 3, a perspective view of the inner wheel vane 5 is shown. This is divided according to the diagram into a base body 15 from which the inner wheel vanes 7 extend radially outward. The recesses 12 are formed on the edge of the corresponding inner wheel vanes 7 between the pressure chamber surface 10 and the side surfaces, wherein these recesses are continued inward into the base body 15 so that the recesses 12 transition into the radial boreholes 11, in order to create a fluid connection of the pressure chambers to the valve slide chamber. In the perspective view, it becomes clear that the recesses are formed, for example, milled, into the edges between the pressure chamber surfaces 10 and the side surface of the inner wheel 5. The recesses have a partially constructed circular cross section that transitions into the radial boreholes.

The invention is not limited in its construction to the preferred embodiment disclosed above. Instead, a plurality of variants is conceivable that makes use of the illustrated solution even for fundamentally different types of constructions.

LIST OF REFERENCE SYMBOLS

1 Camshaft adjuster
2 Camshaft
3 Camshaft axis
4 Drive wheel
5 Inner wheel
6 Outer wheel
7 Inner wheel vane
8 Outer wheel vane
9 Pressure chamber
9*a* Pressure chamber
10 Pressure chamber surface
10*a* Side surface
11 Radial borehole
12 Recess
13 Valve slide chamber
13*a* Opening
14 Valve slide
15 Base body
16 Pressurized medium supply borehole
17 Countersink borehole
18 Pressurized medium supply path
19 Passage borehole
20 Stop disk
21 Flange section
22 Pressurized medium channel

The invention claimed is:

1. Camshaft adjuster for an internal combustion engine, comprising a camshaft adjuster mounted on a camshaft coaxial about a camshaft axis that acts as a transmission element to a drive wheel for a rotational drive of the camshaft and has an inner wheel arranged locked in rotation relative to the camshaft and an outer wheel that can rotate, and that is arranged coaxial, relative to the inner wheel, at least one inner wheel vane is arranged on the inner wheel and at least one outer wheel vane is arranged on the outer wheel, the inner wheel is formed from a base body from which the at least one inner wheel vane extends radially outward, pressure chambers are formed between the at least one outer wheel vane and the at least one inner wheel vane, the pressure chambers have peripheral-side pressure chamber surfaces, radial boreholes are formed in the inner wheel for supplying pressurized medium to the pressure chambers, and the at least one inner wheel vane has, within the pressure chamber surface, a recess into which the corresponding radial borehole opens, wherein the recess extends radially outward beginning in a region of the base body into the pressure chamber surface and along an entire length of the inner wheel vane.

2. Camshaft adjuster according to claim 1, wherein the inner wheel has a central opening that is formed concentric to the camshaft axis and the radial borehole extends between the central opening and the recess.

3. Camshaft adjuster according to claim 1, wherein the pressure chamber surface contacts a side surface of a corresponding one of the outer wheel vanes in a peripheral-side end position of the inner wheel relative to the outer wheel and the corresponding recess forms a residual pressure chamber in the pressure chamber surface.

4. Camshaft adjuster according to claim 3, wherein a surface area of the side surface of the outer wheel vane on which the pressure chamber surface comes into contact in a peripheral-side end position of the inner wheel relative to the outer wheel comprises at least 20% of the surface area of the side surface.

5. Camshaft adjuster according to claim 1, wherein the recess is arranged on one edge of the pressure chamber surface relative to a side surface of the inner wheel vane.

6. Camshaft adjuster according to claim 1, wherein each of the inner wheel vanes is formed with at least one of the recesses.

7. Camshaft adjuster according to claim 1, wherein two of the pressure chamber surfaces of the inner wheel vane have a recess.

* * * * *